US006854775B2

(12) United States Patent
Senn

(10) Patent No.: US 6,854,775 B2
(45) Date of Patent: Feb. 15, 2005

(54) BAR LOCK ASSEMBLY

(75) Inventor: Brian A. Senn, South Milwaukee, WI (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/364,132

(22) Filed: Feb. 11, 2003

(65) Prior Publication Data

US 2004/0155471 A1 Aug. 12, 2004

(51) Int. Cl.[7] ..... E05C 19/08

(52) U.S. Cl. ..... 292/285; 292/259 R; 292/281; 292/286; 292/DIG. 32; 292/DIG. 71

(58) Field of Search ..... 292/285, 286, 292/281, 259 R, DIG. 32, DIG. 71, 200, DIG. 29

(56) References Cited

U.S. PATENT DOCUMENTS

| | | | | | |
|---|---|---|---|---|---|
| 160,723 | A | * | 3/1875 | Smith et al. | 292/281 |
| 911,972 | A | * | 2/1909 | Gill | 292/286 |
| 1,334,320 | A | * | 3/1920 | Schmidgall | 292/216 |
| 1,483,923 | A | * | 2/1924 | Arnold | 292/218 |
| 1,485,661 | A | * | 3/1924 | Ziehlke | 292/285 |
| 1,873,645 | A | * | 8/1932 | Harbert | 292/283 |
| 1,925,798 | A | * | 9/1933 | Epton et al. | 16/232 |
| 2,298,259 | A | * | 10/1942 | Dunham | 292/218 |
| 3,281,177 | A | | 10/1966 | Tenenbaum | |
| 3,370,877 | A | | 2/1968 | Hallberg | |
| 3,836,186 | A | * | 9/1974 | Kennedy | 292/189 |
| 3,917,328 | A | * | 11/1975 | De Filippi | 292/7 |
| 3,933,384 | A | * | 1/1976 | Schuller et al. | 292/285 |
| 3,986,741 | A | * | 10/1976 | Giovannini | 292/268 |
| 4,134,281 | A | * | 1/1979 | Pelcin | 70/208 |
| 4,397,488 | A | | 8/1983 | Pastva | |
| 4,844,524 | A | * | 7/1989 | Pastva | 292/218 |
| 5,314,218 | A | * | 5/1994 | Nadherny | 292/256.5 |
| 5,456,506 | A | * | 10/1995 | Bartlett | 292/281 |
| 5,562,316 | A | | 10/1996 | Bullock et al. | |
| 5,791,173 | A | * | 8/1998 | Montes | 70/101 |
| 6,053,545 | A | | 4/2000 | Asmundson et al. | |
| 6,367,852 | B1 | * | 4/2002 | Aspenwall | 292/285 |

FOREIGN PATENT DOCUMENTS

DE 2847744 * 4/1980

* cited by examiner

*Primary Examiner*—Daniel P. Stodola
*Assistant Examiner*—Carlos Lugo
(74) *Attorney, Agent, or Firm*—John W. Harbst

(57) ABSTRACT

A bar lock assembly for securing closed a swingably movable door relative to an opening in a body of a vehicle or container. The bar lock assembly includes a one-piece member for selectively interconnecting a pair of axially spaced pivots fixedly secured to the body of the vehicle with the movable door whereby securing the door in the closed position. The one-piece member includes a mounting portion, a handle mounting portion, and a web portion. The mounting portion extends along one edge of the member for operable association with the pivots on the vehicle body whereby allowing the bar lock assembly to move between latched and unlatched conditions. The handle mounting portion of such one-piece member is provided at an opposed edge of the member for mounting a manually operated handle for movement in a plane extending generally parallel to an outer surface on the door. The web portion is formed integral with and extends between the mounting portion and the handle mounting portion.

27 Claims, 2 Drawing Sheets

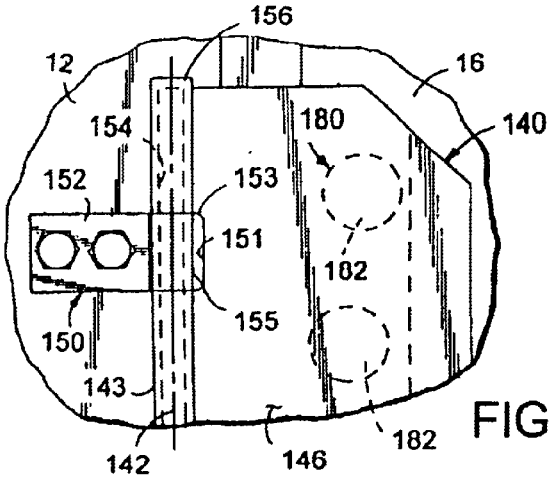
FIG. 4
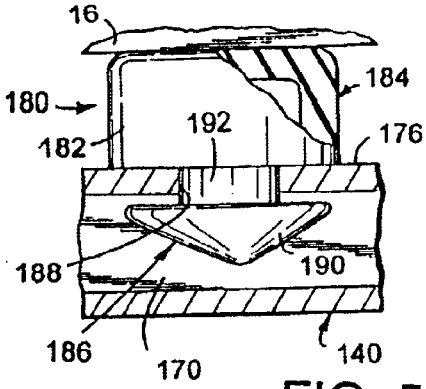
FIG. 5
FIG. 7
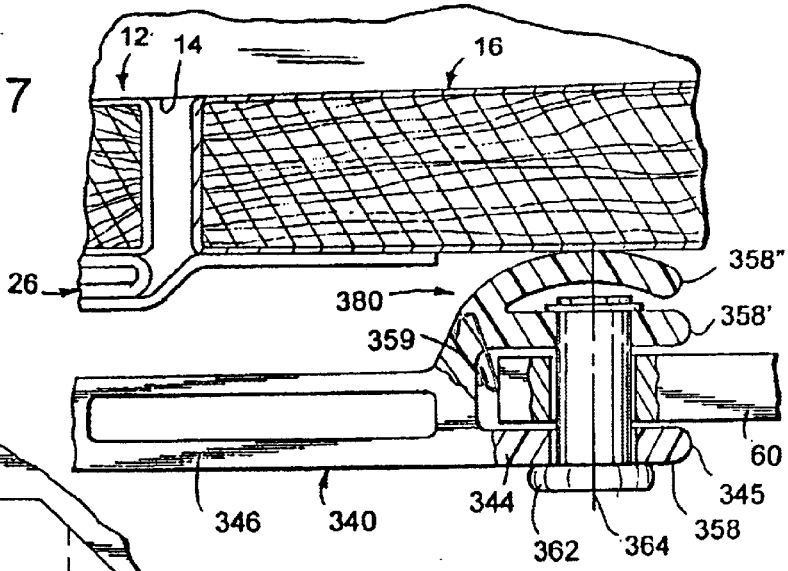
FIG. 6
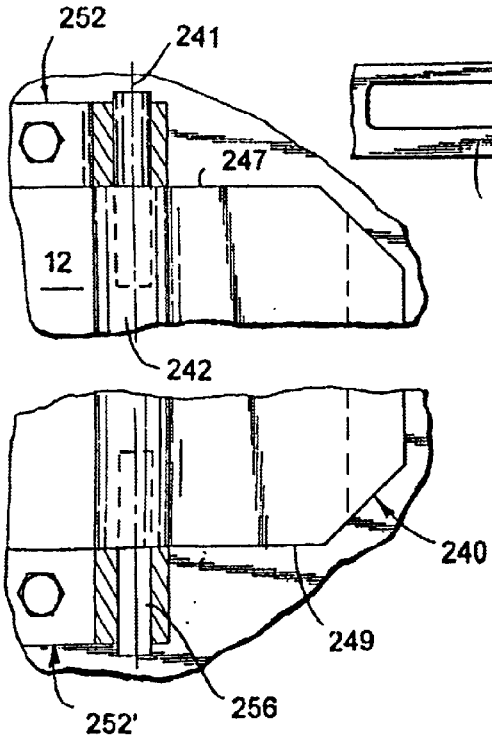
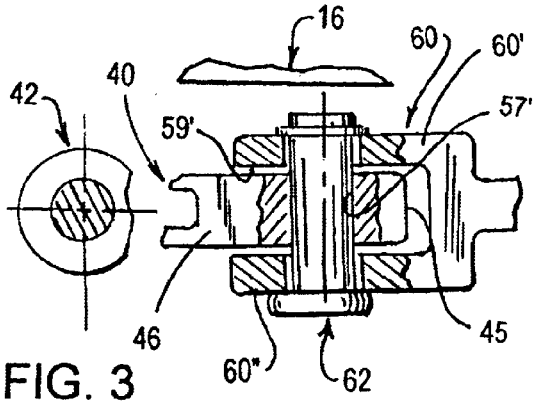
FIG. 3

BAR LOCK ASSEMBLY

FIELD OF THE INVENTION

The present invention generally relates to a door closing mechanism and, more particularly, to a bar lock assembly for releasably securing a door in a closed position relative to an opening in a walled enclosure.

BACKGROUND OF THE INVENTION

Many trucks, truck trailers, cargo and/or freight containers, tankers and like vehicles typically have a walled enclosure which is provided with an opening in at least one wall thereof to allow loading and unloading of the vehicle or container. Conventionally, a door is hinged along one side for swinging movements into the plane of the wall for releasably closing the opening. A gasket seal is commonly arranged in combination with such door to inhibit moisture, dust, dirt, debris and related contaminating elements from passing between the door and the walled enclosure and entering through the opening when the door is closed.

To maintain the door in a closed position, a bar lock assembly is known to be provided between the door and the walled enclosure. Such a bar lock assembly is usually fabricated from several separate components or pieces which are typically welded together. For example, a conventional bar lock assembly includes an elongated bar pivotally mounted to the walled enclosure of the vehicle and has welded thereto a locking handle bracket having a locking handle pivotally attached thereto. The locking handle is adapted to coact with a latch on the door to hold the door in the closed position. The elongated bar of such bar lock assemblies usually includes a piece of elongated round or flat stock having at least two hinge barrels, sometimes referred to as straps, welded thereto. A pair of coaxially arranged hinge butts, secured to the walled enclosure, are pivotally interconnected to the hinge barrels as through pivot pins.

As will be appreciated, welding several individual pieces comprising the bar lock assembly requires a labor intensive effort and, thus, is relatively expensive. Moreover, when several components forming a bar lock are welded to each other, it is customary to provide fixtures for holding the various components in their desired assembled relationship relative to each other. Of course, the need to provide such fixtures further increases the fabrication expense, and, thus, the overall costs for the bar lock assembly. Additionally, certain expertise is required to properly arrange the components relative to the fixtures for welding. This also adds to the overall cost of the bar lock assembly.

To enhance the ability of the gasket to seal about the marginal edge of the door, a bar lock assembly is frequently designed to apply a compressive force against an outer surface of the door when the locking handle is arranged in operable combination with the latch to hold the door closed. When a separate locking handle bracket is welded to the elongated round or flat stock, tolerance variations coupled with inadvertent but inescapable human errors in repetitively locating the respective components in their respective fixtures leads to inconsistent angular orientations and differences between the respective parts. If the tolerance variations and accumulation of errors are extreme or excessive, the compressive force exerted by the bar lock assembly on the door and, thus, on the gasket may be inadequate for the intended purpose. Accordingly, there may be leakage between the gasket and the walled enclosure which can lead to contaminants, i.e., moisture, dust, dirt and debris, entering the walled enclosure through the opening. Moreover, when the pressure exerted by the bar lock assembly against the door is inadequate, premature wear on the door, door hinges, gaskets and related components can result from excessive vibration between the door and walled enclosure. On the other hand, when excessive tolerance variations cause the door lock assembly to exert too much pressure against the door, the operator can have difficulty in securing the handle lock in locked relation with the lock on the door.

Thus, there is a need and continuing desire for an improved bar lock assembly for holding a door in a closed position, which is strong and simple in construction, while substantially reducing the fixtures required for assembly thereby making it more economical to manufacture.

SUMMARY OF THE INVENTION

In view of the above, and in accordance with one aspect of the present invention, there is provided a bar lock assembly for releasably closing and securing a swingably movable door in a closed position relative to an opening in a body of a vehicle. The bar lock assembly includes a member for selectively interconnecting a pair of axially displaced pivots fixedly secured to the body of the vehicle with the movable door whereby securing the door in the closed position. Such member of the bar lock assembly includes a mounting portion, a handle mounting portion, and a web portion all integrally embodied in a one-piece structure. The mounting portion extends along one edge of the member for operable association with the pivots on the body of the vehicle whereby allowing the bar lock assembly to move between latched and unlatched conditions. The handle mounting portion of such one-piece member is disposed toward a laterally spaced and opposed edge of the member for mounting a manually operated handle adapted for pivotal movement in a plane extending generally parallel to an outer surface on the door. Moreover, the web portion is formed integral with and extends between the mounting portion and the handle mounting portion of the one-piece member. In one form, at least one of the locking handle mounting portion on the member and an end of the locking handle adapted to be arranged closest to said the member is formed with a clevis-like configuration According to another aspect, there is provided a bar lock assembly adapted to be mounted on a wall having an opening therein and which operably cooperates with suitable latch structure for releasably maintaining a swingable door in a closed position extending across the opening in the wall. The bar lock assembly includes a one-piece member adapted to swing relative to the wall about an elongated axis disposed adjacent and along one edge of the member. In one form, such member further includes a generally U-shaped channel provided along at least a portion of an opposed edge of the member for accommodating a manually operated handle adapted to coact with latch structure on the door. Such one-piece member further defines a door engaging surface provided between the edges thereof and which is cooperatively engagable with the door when the door is to be moved from the open position to the closed position.

According to this aspect, the door engaging surface of the bar lock assembly member has a first distance extending generally parallel to the axis about which such member pivots and a second distance extending between the opposed edges, with the first distance being greater than the second distance. In a preferred form, the one-piece member of the bar lock assembly includes a web extending between the edges.

According to another aspect, there is provided a bar lock assembly for releasably securing a door in a closed position wherein the door extends across and closes an opening in a walled enclosure. As is known, the door swingably moves about a generally vertical axis disposed adjacent a first marginal edge of the opening in the walled enclosure. The bar lock assembly includes hinge structure adapted to be secured to the walled enclosure adjacent a second vertical marginal edge of the opening in the walled enclosure. According to this aspect, the bar lock assembly includes an elongated one-piece body defining a hinge portion configured to operably cooperate with the hinge structure in mounting the body for swinging movement about the vertical axis and relative to the opening in the walled enclosure. According to this aspect, the bar locking assembly further includes a locking handle mounting portion arranged in spaced relation from the hinge portion and a web portion extending between and rigidly joining the hinge portion and the locking handle mounting portion. Moreover, the bar lock assembly includes a locking handle having one end adapted for pivotal attachment to the locking handle mounting portion of the one piece body for facilitating pivotal movement of the locking handle and swinging movement of the one-piece body relative to the hinge structure and for securing the door in the closed position across the opening in the walled enclosure.

In a preferred form, the vertical axis about which the one-piece body is adapted to swingably move is laterally spaced from the marginal edge of the opening defined by the walled enclosure. Moreover, the one piece body is preferably configured such that the web portion thereof is sized to exceed a distance measured between the vertical axis about which the one-piece body is adapted to swingably move and a vertical edge of the door arranged closest to the hinge structure when said door is in the closed position.

To reduce the overall weight of the bar lock assembly, the web portion of the elongated body preferably defines a channel or void having a closed margin. In a most preferred form, the one-piece body is formed from extruded aluminum or aluminum alloy.

In a preferred embodiment, the web structure extending between the hinge portion and channel portion of the elongated body is configured with a door engaging surface for promoting closure of the door from an open position. Moreover, the bar lock assembly preferably includes compressible structure whereby allowing the bar lock assembly to exert a compressive closing force against the door.

An object of the present invention is to provide an improved bar locking assembly for securely maintaining a door within a plane of an associated walled enclosure.

Another object of this invention is to provide a bar locking assembly for securing a swingable door in a closed position but having fewer parts than heretofore known devices whereby maintaining simplicity while reducing the cost to manufacture such an assembly.

Still another object of the present invention is to provide a bar locking assembly which is configured such that a consistent relationship is provided between a locking handle of such assembly and the confronting outer surface of the swingably movable door.

Yet another object of the present invention is to provide a bar locking assembly embodying an extruded one-piece member defining a channel for not only reducing the overall weight of the bar assembly but also adding significant stiffness to the bar locking assembly whereby enhancing its ability to maintain the door in the closed position.

These and other objects, aims and advantages of the subject invention will be understood and better appreciated from the following detailed description, appended claims and drawings.

DESCRIPTION OF THE DRAWINGS

FIG. 3 is a fragmentary view similar to FIG. 2 but showing an alternative embodiment of the present invention;

FIG. 4 is an enlarged fragmentary view of an alternative embodiment of the present invention;

FIG. 5 is an enlarged sectional view of an alternative form of compressible structure usable in combination with the present invention;

FIG. 6 is fragmentary view of an alternative embodiment of the invention; and FIG. 7 is an enlarged view similar to FIG. 2 but showing an alternative form for the bar lock assembly.

DETAILED DESCRIPTION OF THE INVENTION

Figure 1:
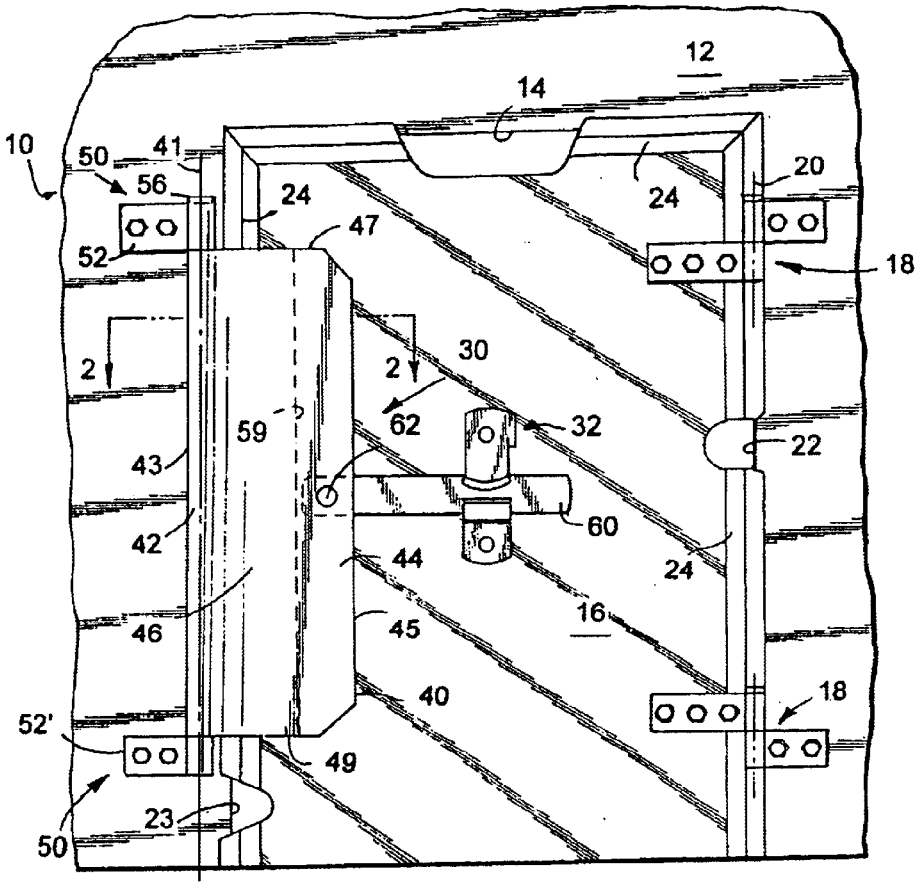
FIG. 1 is an elevational view of a walled enclosure having an opening and a swingable door which is releasably held closed by a bar lock assembly according to the present invention.

The present invention is susceptible of embodiment in multiple forms, and there is shown in the drawings and will hereinafter be described preferred embodiments of the invention, with the understanding the present disclosure sets forth exemplifications of the invention which are not intended to limit the invention to the specific embodiments illustrated and described.

Referring now to the drawings, wherein like reference numerals indicate like parts throughout the several views, there is shown in FIG. 1 a conventional transport vehicle or container, generally identified by reference numeral 10, having a walled body or enclosure 12 defining an opening 14. As is typical, a door 16 is mounted by conventional hinge structure 18 for swinging movement about a generally vertical axis 20 disposed adjacent a first vertical marginal edge 22 of the opening 14 to allow the door 16 to move into an out of the plane of the walled body 12 whereby releasably closing the opening 14.

Figure 2:
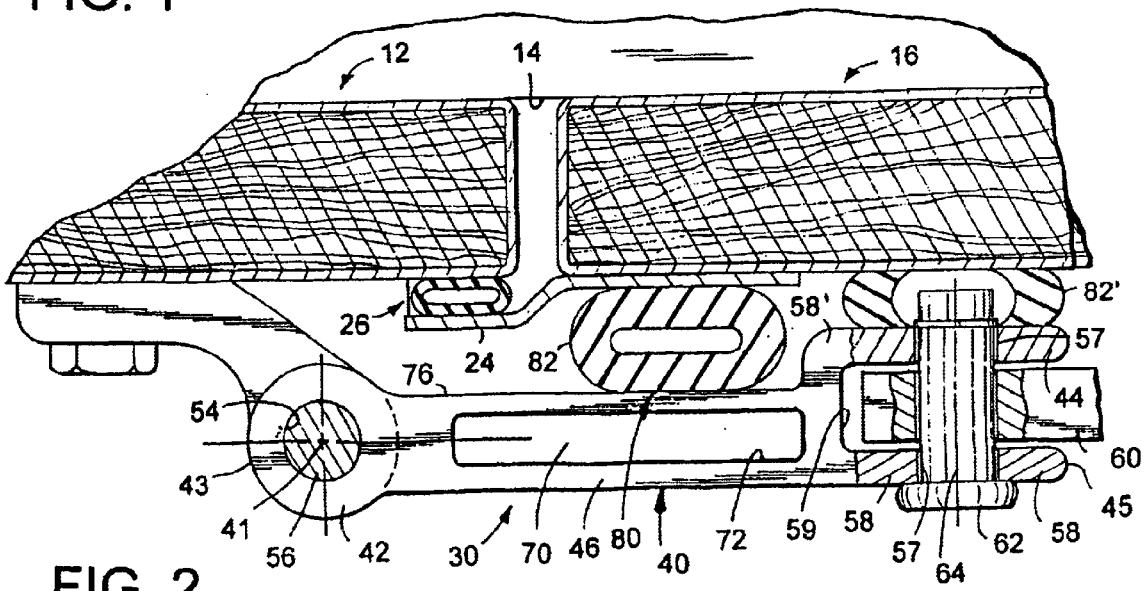
FIG. 2 is an enlarged sectional view taken along line 2—2 of FIG. 1.

In the embodiment shown, door 16 is preferably flat, substantially rectangular and metal clad. Preferably, marginal edges of the opening 14 are overlapped by an outer peripheral flange 24 (FIG. 2) provided about the relevant edges of the door 16. Moreover, and as shown in FIG. 2, seal structure 26 is preferably provided and adapted to operatively cooperate with the exterior of the walled body 12 and door 16 to effect a seal when the door 14 is closed.

According to the present invention, a bar lock assembly, generally identified by reference numeral 30, is provided for releasably maintaining the door 16 in a closed position. As is known, the bar lock assembly 30 is arranged for operable association with a conventional latch or clip lock 32 (FIG. 1) mounted to an outer face of the door 16. Though the lock assembly 30 is shown in FIG. 1 and described in use with a single door 16, it should be understood the invention can easily and readily be adapted to multiple door closures without detracting or departing from the spirit and scope of the present invention.

A salient aspect of the present invention relates to the provision of a one-piece body 40 adapted and configured to be swingably mounted to the walled enclosure 12 about an axis 41 preferably disposed adjacent a second vertical marginal edge 23 (FIG. 1) defined by the opening 14 in the walled enclosure 12 in opposed relation relative to the other marginal edge 22 of opening 14. In the embodiment illustrated in FIG. 1, body 40 includes a hinge portion 42 disposed along one edge 43 of body 40, a locking handle mounting portion 44 provided toward an opposed edge 45 of body 40, and a web portion 46 formed integral with and extending between hinge portion 42 and portion 44 of body 40.

In the illustrated embodiment, the one-piece body or locking member 40 of the bar lock assembly 30 has a generally rectangular configuration which, when attached to the walled enclosure 12, is elongated in a vertical direction. That is, body 40 has a first distance extending generally parallel to the axis 41 about which body 40 swingably moves and a second distance extending between the opposed edges 43, 45. In a preferred form, edges 43, 45 of body 40 are laterally spaced and preferably extend in generally parallel relation relative to each other. In the illustrated embodiment, the first distance is greater than the second distance.

The hinge portion 42 of the elongated body 40 is adapted to operably cooperate with suitable hinge structure 50 in mounting the bar lock assembly 30 for swinging movement about axis 41 and relative to the walled enclosure 12. In one form, hinge structure 50 includes a pair of axially spaced hinge butts 52 and 52' secured to the walled enclosure 12 in a conventional manner and in axially spaced relation relative to each other. Suffice it to say, hinge structure 50 is secured adjacent to the second marginal edge 23 of the opening 14 in the walled enclosure 12 and defines the axis 41 about which the elongated body 40 swingably moves. In the embodiment illustrated in FIG. 1, the hinge butts 52, 52' comprising the hinge structure 50 are disposed toward opposed ends 47, 49, respectively, of and embrace the elongated body 40 therebetween.

In one form, hinge portion 42 of body 40 defines an elongated recess or bore 54 for accommodating a pivot pin 56 which passes through and is journalled by the hinge butts 52, 52'. Alternatively, and without detracting or departing from the spirit and scope of the present invention, each end of the hinge portion 42 of the elongated body 40 can be designed with a blind bore which accommodates the free end of a hinge pin journalled by a respective hinge butt 52, 52'.

In that form shown in FIG. 2, the locking handle mounting portion 44 is provided along at least a lengthwise section of edge 45 of the one-piece body 40 and has a yoke or clevis-like configuration including a pair of bifurcated arms 58, 58'. Notably, arms 58, 58' extend laterally outward from and are integrally formed with the web portion 46. As shown, arms 58, 58' of the locking handle mounting portion 44 define a channel 59 therebetween which opens to edge 45 of the elongated body 40. In one form, the channel 59 extends substantially the length of the one-piece body 40. Notably, however, and from an operational perspective, channel 59 need only extend for a lengthwise section along the body edge 45. In a most preferred form, channel 59 of the handle mounting portion 44 of body 40 extends along and generally midway between the opposed ends 47, 49 of the elongated body 40. As shown, each arm 58, 58' of the locking handle mounting portion 44 defines a bore or opening 57 which are aligned relative to each other.

One end of a manually operated locking handle 60, is secured between the joined tines 58, 58' of the handle mounting portion 44 of the elongated body 40 by a pivot pin 62 journalled by the aligned bores or openings 57 in arms 58, 58' of the handle mounting portion 44 of the elongated body 40. As will be appreciated, the pivot pin 62 defines a rotational axis 64 about which handle 60 pivots and which extends generally normal to the axis 41 about which the elongated body 40 swingably moves. Such an arrangement allows for manual rotation of the locking handle or lever 60 in a plane extending generally parallel to the outer surface of the door 16 and into and from operable locking relation with the conventional latch or handle lock 32 mounted to the outer face of the door 16. The elongated configuration of the locking handle or lever 60 furthermore promotes swinging movement of the bar locking mechanism 30 about axis 41.

In an alternative arrangement, shown in FIG. 3, the web portion 46 of the one-piece body 40 can laterally extend to edge 45 and define a bore or hole 57 therein. In such alternative arrangement, the end of the locking handle 60 closest to the one-piece member 40 can be provided with a yoke or clevis-like configuration including a pair of bifurcated arms or tines 60', 60" defining a channel 59' therebetween. As shown, each arm or tine 60', 60" on the locking handle 60 defines a bore or opening 57' which are aligned relative to each other. In this embodiment, the bifurcated arms or tines 60', 60" of the locking handle 60 are disposed on opposed sides of the free edge 45 and are pinned, as by pivot pin 62, to the one-piece body 40 spaced from the hinge portion 42. Such alternative design likewise provides for manual rotation of the locking handle or lever 60 in a plane extending generally parallel to the outer surface of the door 16 and into and from operable locking relation with the conventional latch or handle lock 32 (FIG. 1) mounted to the outer face of the door 16.

In a preferred form, the one-piece body 40 is fabricated or formed as an extrusion which advantageously allows for orientation of the metallic structure thereof. To reduce the overall weight of the assembly 30, body 40 is preferably formed from a lightweight alloy material such as an aluminum alloy. Any other suitable material would equally suffice as long as such materials have the necessary strength and preferably light weight properties for the particular application.

As shown in FIG. 2, the integrally formed web portion 46 extending between the hinge portion 42 and the locking handle mounting portion 44 of the elongated body 40 is preferably designed to both significantly enhance stiffness characteristics of the elongated body 40 as well as reduce the overall weight of the bar lock assembly 30. To accomplish both goals, the web portion of the elongated body 40 preferably defines a channel or void 70 defining a closed marginal edge 72 and preferably opening to the opposed ends 47, 49 of the elongated body 40. As will be appreciated by those skilled in the art, when the elongated body 40 is fabricated or formed as a result of an extrusion process, providing the open ended channel or void 70 extending the length of the elongated body 40 and in the direction of extrusion can be readily accomplished. Of course, providing such a void 70 along the length of the elongated body 40 likewise and advantageously reduces the overall weight of the bar lock assembly 30.

As illustrated in FIG. 2, the one piece body 40 is preferably configured such that the web portion 46 defines a relatively broad exterior surface 76 adapted to be arranged in confronting relation with the exterior surface of the door 16 when the door 16 is in the closed position. Notably, in a preferred embodiment, the exterior surface 76 on body 40 is sized to extend across and exceed a distance measured between the vertical axis 41 about which the one-piece body 40 is adapted to swingably move and a vertical edge of the door 16 arranged closest to the hinge structure 50 when the door 16 is in the closed position.

In a preferred form, compressible structure 80 is arranged between the one-piece body 40 and the exterior surface of the door 16 when the door is in the closed position. In one form, the compressible structure 80 preferably includes an elongated strip 82 of any suitable material, i.e., hollow rubber strip, suitably secured as by adhesive or the like to surface 76 of the one-piece body 40 preferably in an elongated direction extending generally normal to the ends 47, 49 of the one-piece body 40. Alternatively, and as shown in FIG. 2, a plurality of suitable resilient or compressible material strips 82 and 82' can be suitably secured, in laterally spaced relation relative to each other, to a surface of body 40 adapted to be arranged in confronting relation with the door 16 when door 16 is in a closed position. Suffice it to say, the compressible structure 80 is specifically designed to enlarge or bulge when the door 16 is open or unlocked and is compressible between body 40 and the exterior of the door 16, as shown in FIG. 2, when the locking bar 60 is conditioned in locked relation relative to door 16. As will be appreciated, when structure 80 is compressed, it exerts an additional closing force against the seal or gasket structure 26 whereby enhancing sealing capabilities between the opening 14 and door 16

As will be appreciated, integrally forming the hinge portion 42, the handle mounting portion 44, and web portion 46 as a one-piece body 40 rather than individual components advantageously orientates the bar lock assembly 30 relative to the door 16 when the door is in the closed position. More specifically, integrally forming the hinge portion 42, the handle mounting portion 44, and web portion 46 as a one-piece body 40 provides a relatively consistent relationship between body 40 and the exterior, confronting surface on the door 16. As such, the bar lock assembly 30 provides a relatively consistent closing pressure on the gasket seal structure 26 when the door 16 is in the closed position.

FIG. 4 illustrates an alternative form for the one-piece body of the lock assembly. This alternative form of the one-piece body is designated generally by reference numeral 140. The elements of this alternative form of elongated one-piece body that are functionally analogous to those components discussed are designated by reference numerals identical to those listed above, with the exception this embodiment uses reference numerals in the one-hundred series.

In the form illustrated in FIG. 4, the hinge portion 142 of the elongated one-piece body 140 is provided with at least two identical, axially spaced recesses or cutouts 151, with only one being illustrated. Each recess or cutout 151 is axially spaced from the respective end of and opens to edge 143 of body 140. As shown, each recess or cutout 151 can laterally extend past the hinge portion 142 of body 140 for a short distance into the web portion 146 of body 140. Preferably, each recess or cutout 151 has a pair of generally parallel laterally extending edges 153 and 155 which are axially spaced from each other by a predetermined distance. The distance separating edges 153 and 155 is sized generally equal to or slightly greater than the respective size of the respective hinge butt 152 of binge structure 150 adapted to fit and be captured therebetween. As shown, each hinge butt 152 is suitably secured to the enclosure 12 as through any suitable fastener, i.e. bolt, screw, or welding. A pin 156 is endwise inserted from the respective end of the elongated body 140 through the bore 154 and into operable association with the respective hinge whereby swingably mounting the elongated body 140 and, thus, the bar lock assembly to the enclosure 14.

Moreover, FIGS. 4 and 5 illustrate an alternative form for the compressible structure for the bar lock assembly. This alternative form of structure is designated generally in FIGS. 4 and 5 by reference numeral 180. The elements of this alternative compressible structure to be arranged in combination with the bar lock assembly that are functionally analogous to those components discussed are designated by reference numerals identical to those listed above, with the exception this embodiment uses reference numerals in the one-hundred series.

In the exemplary embodiment, the compressible structure 180 includes a series of compressible bumpers or pads 182 individually secured to the one-piece body 140. As illustrated in FIGS. 4 5, each compressible bumper 182 includes a head portion 184 which is designed to enlarge or bulge when the door 16 is open or unlocked and is compressible between body 40 and the exterior surface of the door 16 as long as the locking handle 60 is arranged in a locked condition relative to door 16. As will be appreciated, and like structure 80, when the bumpers or pads 182 are compressed, they exert an additional closing force against the gasket structure 26 (FIG. 2) whereby enhancing sealing capabilities between opening 14 and door 16.

In the example illustrated in FIGS. 4–5, each compressible bumper or pad 182 includes a fastener or attachment portion 186 preferably formed integral with the head portion 184. The fastener or attachment portion 186 extends away from the head portion 184 and is configured to releasably attach the compressible bumper 182 to the one-piece body 140. As shown, the fastener portion 186 of each compressible button or pad 182 is designed for insertion within an aperture, slit or opening 188 defined on surface 176 of the one-piece body 140.

In this embodiment, the fastener portion 186 of each bumper or pad 182 includes a shank 192 having one or more anti-retraction flexible ribs or formations 190 extending from opposite sides of the shank 192. As is known, the rib or formation 190 on the fastener portion 186 is designed to enable relatively easy deformation of the rib 190 for insertion of the fastener portion 186 of the compressible bumper or pad 180 into the opening 188 on the one-piece body and yet relatively difficult removal of the fastening portion 186 of the compressible bumper or pad 182 from the one-piece body 140. Of course, and as will be appreciated, the open channel 170 in the one-piece body 140 facilitates insertion of the fastener portion 186 of the compressible pad or bumper into operable association with the one-piece body 140. As will be appreciated, and without detracting or departing from the spirit of the invention, the compressible structure 80 mentioned above could likewise include such fastening means and/or fasteners designed with similar fastening means for maintaining structure 80 in place relative to the one-piece body 40.

FIG. 6 shows an alternative form for the elongated one-piece body of the bar lock assembly. This alternative form of the elongated one-piece body is designated generally by reference numeral 240. The elements of this alternative form of one-piece body that are functionally analogous to those components discussed above are designated by reference numerals identical to those listed above, with the exception this embodiment uses reference numerals in the two-hundred series.

In the form illustrated in FIG. 6, the hinge portion 242 of the one-piece body 240 includes a stub shaft or pin 256 projecting from each end 247, 249 of the elongated body 240. The stub shafts or pins 256 endwise projecting from the ends 247, 249 of the one-piece body 240 are axially aligned and define an axis 241 about which the one-piece body 240 pivots or swings. As shown, the respective hinge butts 252, 252' are journalled on their respective pin or stub shaft 256 and are secured to the walled body or enclosure 12 by any suitable means or device.

FIG. 7 shows another alternative form for the elongated one-piece body of the bar lock assembly. This alternative form of the elongated one-piece body is designated generally by reference numeral 340. The elements of this alternative form of one-piece body that are functionally analogous to those components discussed above are designated by reference numerals identical to those listed above, with the exception this embodiment uses reference in the three-hundred series.

In the form illustrated in FIG. 7, the one-piece body 340 is formed from a suitable composite material having the necessary strength, rigidity and preferably light weight properties for the particular application. The one-piece body 340 includes a locking handle mounting portion 344, provided along at least a lengthwise section of an edge 345 of the one-piece body 340. As shown, the locking handle mounting portion 344 has a yoke or clevis-like configuration including a pair of bifurcated arms 358, 358'. Notably, arms 358, 358' extend laterally outward from and are integrally formed with a web portion 346 of body 340. As shown, arms 358, 358' of the locking handle mounting portion 344 define a channel 359 therebetween which opens to edge 345 of the elongated body 340. In one form, the channel 359 extends substantially the length of the one-piece body 340. Notably, however, and from an operational perspective, the channel 359 need only extend for a lengthwise section along the body edge 345.

One end of the manually operated locking handle 60 is secured between the joined tines 358, 358' of the handle mounting portion 344 of the elongated body 340 by a pivot pin 362 defining a rotational axis 364 about which handle 60 pivots and which extends generally normal to the major plane of the door 16. Such an arrangement allows for manual rotation of the locking handle or lever 60 in a plane extending generally parallel to the outer surface of the door 16 and into and from operable locking relation with the conventional latch or handle lock 32 (FIG. 1) mounted to the outer face of the door 16 (FIG. 1).

In the embodiment illustrated in FIG. 6, compressible structure 380 is formed as part of the elongated body 340. More specifically, when the elongated body 340 is initially formed, a flexible third tine 358" is formed integral therewith and on that surface of the elongated body 340 adapted to be arranged in confronting relation relative to the door 16 when the door is in the closed position. Tine 358" is arranged in spaced relation from the closest adjacent tine 358'. Suffice it to say, tine 358" has a cantilevered configuration and laterally extends from the web portion 346 of the elongated body 340. The third tine 348" is specifically designed and configured to act as a cantilevered spring which exerts an additional closing force against the seal or gasket structure 26 whereby enhancing sealing capabilities between the opening 14 and door 16 when the locking bar 60 is conditioned in locked relation relative to door 16.

As will be appreciated from an understanding of the present invention, the locking handle 60 connected to the one-piece body 40 is used to lock the door 16 in a closed position. Movement of the handle 60 toward the door 16 rotates the elongated body 40 about its vertical hinge axis 41 and the surface 76 of the elongated body 40 can consequently engage the outer surface of the door 16 whereby moving the door 16 toward a closed position extending across the opening 14 in the walled enclosure 12. After the door 16 is closed, the handle 60 can be moved about the pivot axis 64 of pin 62 to a position where it extends substantially normal to the axis 41 about which the bar assembly swingably moves. Thereafter, the locking handle 60 is manually manipulated into operable locking relation with the latch or handle lock 32 on the exterior of the door 16 whereby releasably securing the door 16 in a closed position.

In a preferred embodiment, and before handle 60 is arranged in operable locking engagement with the lock 32, the compressible structure 80 on the elongated body is compressed. As will be appreciated, compression of structure 80 imparts an additional closing force on the door 16 and serves to enhance the capability of the seal or gasket 26, between the door 16 and walled enclosure 12, to inhibit dirt, debris, and elements from passing therebetween and into the walled enclosure 12 through the opening 14. Thus, not only will the bar assembly 30 of the present invention provide a simple and effective locking action, but such result is obtained without the necessity of providing close tolerances between the door and the walled enclosure 12.

Additionally, and since the hinge portion 42, handle mounting portion 44 and web portion 46 of body 40 are all formed integral relative to each other, the need for additional welding fixtures for aligning such components relative to each other has been eliminated, thus, reducing the overall cost of producing the bar lock assembly 30. Moreover, and since the need to align and weld the various components relative to each other has been eliminated, the present invention offers a simplified method of manufacturing a bar lock assembly which substantially eliminates the likelihood of human error. As will be appreciated from an understanding of the present invention, forming the hinge portion 42, handle mounting portion 44 and web portion 46 as a one-piece integral unit will furthermore result in fewer parts being required for the bar assembly 30. As known to those experienced with manufacturing operations, a reduction in individual parts and assembly operations advantageously results in savings in labor. Furthermore, the aesthetics of the bar lock assembly 30 is enhanced since there are no weld joints required for attaching other or individual pieces to the one-piece body 40.

In a preferred form, the one-piece body 40 which hingedly secures the bar lock assembly 30 to the walled enclosure 12 is formed or fabricated from aluminum, aluminum alloy, a composite or other lightweight yet strong material. To further reduce the overall weight of the bar assembly 30, the one-piece body 40 for hingedly securing the bar lock assembly 30 to the walled enclosure 12 is provided with a channel or void 70 extending the length thereof. Testing has revealed, such configuration allows the one-piece body 40 to offer a resistance to bending which is almost double the resistence offered by a standard size round tube typically used for this application. As will be readily appreciated by those skilled in the art, the added stiffness afforded by the preferred design of the one-piece body 40 enhances not only the initial locking capability of the bar lock assembly of the present invention but furthermore enhances the resistence of the bar lock assembly from becoming inadvertently separated from the lock 32 even after an outwardly directed force is applied to the door 16 whereby maintaining the door 16 in a closed position relative to the enclosure 12 during transportation of the vehicle between locations.

From the foregoing it will be readily appreciated and observed that numerous modifications and variations can be effected without departing from the true spirit and scope of the novel concept of the present invention. It will be appreciated that the present disclosure is intended to set forth an exemplification of the present invention which is not intended to limit the invention to the specific embodiment illustrated. The disclosure is intended to cover by the appended claims all such modification and colorful variations as fall within the spirit and scope of the claims.

What is claimed is:

1. A bar lock assembly for releasably securing a door in a closed position, wherein said door extends across and closes an opening defined by a walled enclosure, with said door being swingable about a generally vertical axis disposed adjacent a first vertical marginal edge of said opening, said bar lock assembly comprising:

hinge structure for securing said bar lock assembly to said walled enclosure adjacent a second vertical marginal edge of said opening, with said hinge structure, after being secured to said walled enclosure, defining a pivot axis for said bar lock assembly;

a one-piece body operably disposed to only one lateral side of said pivot axis and defining a hinge portion configured to operably cooperate with said hinge structure in mounting said one-piece body for swinging movements independent of and relative to said door and said opening in said walled enclosure, a locking handle mounting portion arranged in laterally spaced relation from the hinge portion, and a web portion extending between and rigidly joining said hinge portion and said locking handle mounting portion, with said web portion defining a surface spaced from said hinge portion, said surface on said web portion operably engaging and urging said door when said door is moved to the closed position, and wherein said one-piece body results from a single manufacturing process; and a locking handle having one end adapted for pivotal attachment to the locking handle mounting portion of said one-piece body for facilitating pivotal movement of said handle and swinging movements of said one-piece body relative to the opening in said walled enclosure and for securing said door in said closed position across said opening defined by said walled enclosure.

2. The bar lock assembly according to claim 1 wherein the pivot axis about which said one-piece body swingably moves is laterally spaced from the second vertical marginal edge of the opening defined by the walled enclosure.

3. The bar lock assembly according to claim 2 wherein said one-piece body is configured such that the web portion thereof is sized to exceed a distance measured between the pivot axis about which said one-piece body swingably moves and a vertical edge of the door arranged closest to the hinge structure when said door is in said closed position.

4. The bar lock assembly according to claim 1 wherein the web portion of said body defines a channel having a closed margin.

5. The bar lock assembly according to claim 1 wherein one of said locking handle mounting portion on said one-piece body and an end of said locking handle adapted to be arranged closest to said elongated one-piece body is formed with a clevis-like configuration.

6. The bar lock assembly according to claim 1 further including compressible structure secured to said body in confronting relation relative to the door such that, when the door is closed, said structure is compressed between the door and said one-piece body.

7. The bar lock assembly according to claim 6 wherein said compressible structure includes a series of elastomeric bumpers secured to the one-piece body.

8. A bar lock assembly adapted to be mounted on a wall having an opening therein for releasably maintaining a door, swingable between open and closed positions, in a closed position extending across the opening in said wall, said door having a generally flat outer surface configuration along with a lock mounted thereon, said bar lock assembly comprising:

a one-piece locking member mountable on said wall for swinging movements independent of and relative to said door and about an elongated axis defined adjacent and along one edge of said one-piece member such that said locking member is operably disposed only to one side of said elongated axis, with said locking member defining an open sided channel provided along at least a portion of an opposed edge of said member for accommodating a manually operated handle for movement whereby allowing said handle to coact with said lock on said door, and wherein said member further defines a surface movable with said member independent of said door and provided between said edges, with said surface on said web member engaging with the generally flat outer surface configuration on said door so as to urge said door into the closed position, and wherein said one-piece locking member results from a single manufacturing process.

9. The bar lock assembly according to claim 8 wherein said one-piece locking member has a length defined by a first distance, extending generally parallel to the axis about which said locking member swings, and a width defined by a second distance extending between said edges of said locking member, and wherein said first distance is greater than said second distance.

10. The bar lock assembly according to claim 8 wherein said one-piece member includes a web integrally formed with and extending from said channel toward said one edge, with said web of said one-piece locking member defining an opening having a closed margin.

11. The bar lock assembly according to claim 8 wherein said one-piece locking member is formed as a metal extrusion.

12. The bar lock assembly according to claim 8 further including compressible structure secured to said surface on said one-piece member extending between said edges of said member in confronting relation relative to the door such that, when the door is closed, said structure is compressed between the door and said one-piece locking member.

13. The bar lock assembly according to claim 12 wherein said compressible structure includes a series of elastomeric bumpers secured to said one-piece locking member.

14. The bar lock assembly according to claim 12 wherein said compressible structure comprises an elongated strip of resilient material secured to said one-piece member and arranged in confronting relation relative to said door.

15. A closure mechanism for releasably closing and securing a door, swingably movable between open and closed positions, relative to an opening in a body of a vehicle, said closure mechanism comprising:

an elongated member for selectively interconnecting a pair of axially displaced hinge members fixedly secured to the body of said vehicle with the swingably movable door whereby securing said door in said closed position, with said hinge members combining with each other to define a pivot axis to only one lateral side of which said elongated member is operably disposed, and with said elongated member having an integral hinge portion extending along one edge thereof for operable association with the hinge members on the body of said vehicle whereby allowing said elongated member to swingably move independently of and relative to said door between latched and unlatched conditions, with said elongated member having a locking handle mounting portion adjacent an opposed edge and whereat a manually operated handle is adapted to be pivotally connected for movement about an axis extending generally normal to the pivot axis defined by said hinge members, with said elongated member further including a web portion formed integral with and extending between said hinge portion and said locking handle mounting portion, with a surface on said web portion being movable toward and away from said door in response to swinging movements of said elongated member, and with said surface on said web portion engaging an outer surface of said door as said door is moved from said open to said closed position so as to urge said door into the closed position, and wherein at least one of said locking handle mounting portion, on said elongated member, and an end of said locking handle, adapted to be arranged closest to said elongated member, is formed with a clevis-like configuration, and wherein said elongated body results from a single manufacturing process.

16. The closure mechanism according to claim 15 wherein the web portion of said elongated member defines an open ended channel having a closed margin.

17. The closure mechanism according to claim 15 wherein said elongated member is formed as a metal extrusion.

18. The closure mechanism according to claim 15 further including compressible structure secured to said elongated member so as to be arranged in confronting relation relative to the door and such that, when the door is closed, said structure is compressed between the door and said elongated member.

19. The closure mechanism according to claim 15 wherein said compressible structure includes a series of elastomeric bumpers secured to said surface of said elongated member.

20. The closure mechanism according to claim 15 wherein said compressible structure comprises an elongated strip of compressible material secured to said elongated member.

21. A bar lock assembly for releasably securing a door in a closed position, wherein said door extends across and closes an opening defined by a walled enclosure, with said door being swingable about a generally vertical axis disposed adjacent a first vertical marginal edge of said opening, said bar lock assembly comprising:

a one-piece elongated body mounted for swinging movements independent of and relative to said door, with said one-piece elongated body defining a hinge portion extending along one edge thereof, a locking handle mounting portion arranged at an opposite edge thereof in laterally spaced relation from said hinge portion, and a web portion extending between and rigidly joining said hinge portion and said locking handle mounting portion of said elongated body with said web portion extending a full length of said one piece elongated body;

hinge structure for securing said bar lock assembly to said walled enclosure, with said hinge structure including a pair of hinge pieces adapted to be disposed at and abutting with opposed ends of said one-piece elongated body, and with each hinge piece being configured for operably association with the hinge portion of said one-piece body so as to define a fixed axis about which said one-piece body swingably moves relative to said door and said opening in the walled enclosure; and a locking handle having one end adapted for attachment to the locking handle mounting portion of said one-piece body in a manner allowing for securement of said door in said closed position across said opening defined by said walled enclosure.

22. The bar lock assembly according to claim 21 wherein the fixed axis about which said one-piece body swingably moves is laterally spaced from the second vertical marginal edge of the opening defined by the walled enclosure.

23. The bar lock assembly according to claim 22 wherein said one-piece body is configured such that the web portion thereof is sized to exceed a distance measured between the fixed axis about which said one-piece body swingably moves and a vertical edge of the door arranged closest to the hinge structure when said door is in said closed position.

24. The bar lock assembly according to claim 21 wherein the web portion of said body defines a channel having a closed margin.

25. The bar lock assembly according to claim 21 wherein one of said locking handle mounting portion on said one-piece body and an end of said locking handle adapted to be arranged closest to said elongated one-piece body is formed with a clevis-like configuration.

26. The bar lock assembly according to claim 21 further including compressible structure secured to said body in confronting relation relative to the door such that, when the door is closed, said structure is compressed between the door and said one-piece body.

27. The bar lock assembly according to claim 26 wherein said compressible structure includes a series of elastomeric bumpers secured to the one-piece body.

* * * * *

UNITED STATES PATENT AND TRADEMARK OFFICE

CERTIFICATE OF CORRECTION

PATENT NO. : 6,854,775 B2
DATED : February 15, 2005
INVENTOR(S) : Brian A. Senn

It is certified that error appears in the above-identified patent and that said Letters Patent is hereby corrected as shown below:

Column 8,
Line 17, "FIGS. 4 5" should be -- FIGURE 5 --; and
Line 27, "FIGS. 4-5" should be -- FIGURE 5 --.

Signed and Sealed this

Twenty-fifth Day of October, 2005

JON W. DUDAS
*Director of the United States Patent and Trademark Office*